US008057169B2

(12) United States Patent
Benjamin, Jr. et al.

(10) Patent No.: US 8,057,169 B2
(45) Date of Patent: Nov. 15, 2011

(54) AIRFOIL CORE SHAPE FOR A TURBINE NOZZLE

(75) Inventors: Edward Durell Benjamin, Jr., Simpsonville, SC (US); David John Humanchuk, Simpsonville, SC (US); Daniel David Snook, Moore, SC (US)

(73) Assignee: General Electric Company, Schenectady, NY (US)

( * ) Notice: Subject to any disclaimer, the term of this patent is extended or adjusted under 35 U.S.C. 154(b) by 1080 days.

(21) Appl. No.: 12/138,580

(22) Filed: Jun. 13, 2008

(65) Prior Publication Data

US 2009/0324415 A1 Dec. 31, 2009

(51) Int. Cl.
*F03B 3/12* (2006.01)

(52) U.S. Cl. ..... 415/208.1; 416/223 R; 416/223 A; 416/243

(58) Field of Classification Search ..... 416/223 R, 416/223 A, 243, DIG. 2; 415/208.1
See application file for complete search history.

(56) References Cited

U.S. PATENT DOCUMENTS

| | | | | |
|---|---|---|---|---|
| 5,980,209 | A | 11/1999 | Barry et al. | |
| 7,731,483 | B2 * | 6/2010 | DeLong et al. | 416/223 A |
| 7,785,075 | B2 * | 8/2010 | Botrel et al. | 416/223 A |
| 7,862,303 | B2 * | 1/2011 | Sleiman et al. | 416/223 A |
| 7,862,304 | B2 * | 1/2011 | Saindon et al. | 416/223 A |

OTHER PUBLICATIONS

Edward D. Benjamin et al.; "Airfoil Shape for a Turbine Nozzle"; U.S. Appl. No. 11/848,311, filed Aug. 31, 2007.

* cited by examiner

*Primary Examiner* — George Fourson, III
(74) *Attorney, Agent, or Firm* — Cantor Colburn LLP

(57) ABSTRACT

An article of manufacture includes an object having an airfoil core shape. The airfoil core shape has a nominal profile substantially in accordance with Cartesian coordinate values of X, Y, and Z set forth in TABLE 1 where X and Y are distances in inches which, when connected by smooth continuing arcs, define airfoil profile sections at each distance Z in inches. The profile sections at the Z distances are joined smoothly with one another to form a complete airfoil core shape.

7 Claims, 6 Drawing Sheets

AIRFOIL CORE SHAPE FOR A TURBINE NOZZLE

BACKGROUND OF THE INVENTION

The present invention relates to the art of gas turbines and, more particularly, to an airfoil core shape for a turbine nozzle for a gas turbine.

Many system requirements must be met for each stage of a hot gas path section of a gas turbine in order to meet design goals including an overall improvement in efficiency and airfoil loading. In particular, a stage-one nozzle must meet system requirements including cooling flow and part life. The stage-one nozzle also has a particular set of boundary conditions based on operating conditions of the gas turbine. The nozzle core shape must meet design specifications and also be capable of efficient manufacture.

BRIEF DESCRIPTION OF THE INVENTION

In accordance with one exemplary embodiment of the invention, an article of manufacture includes an object having an airfoil core shape. The airfoil core shape has a nominal profile substantially in accordance with Cartesian coordinate values of X, Y, and Z set forth in TABLE 1 where X and Y are distances in inches which, when connected by smooth continuing arcs, define airfoil profile sections at each distance Z in inches. The profile sections at the Z distances are joined smoothly with one another to form a complete airfoil core shape.

In accordance with another exemplary embodiment of the invention, a turbine includes at least one turbine stage including a plurality of articles of manufacture. Each of the plurality of articles of manufacture includes an airfoil core shape. The airfoil core shape has a nominal profile substantially in accordance with Cartesian coordinate values of X, Y, and Z set forth in TABLE 1 where X and Y are distances in inches which, when connected by smooth continuing arcs, define airfoil profile sections at each distance Z in inches. The profile sections at the Z distances are joined smoothly with one another to form a complete airfoil core shape.

DETAILED DESCRIPTION OF THE INVENTION

Figure 1:
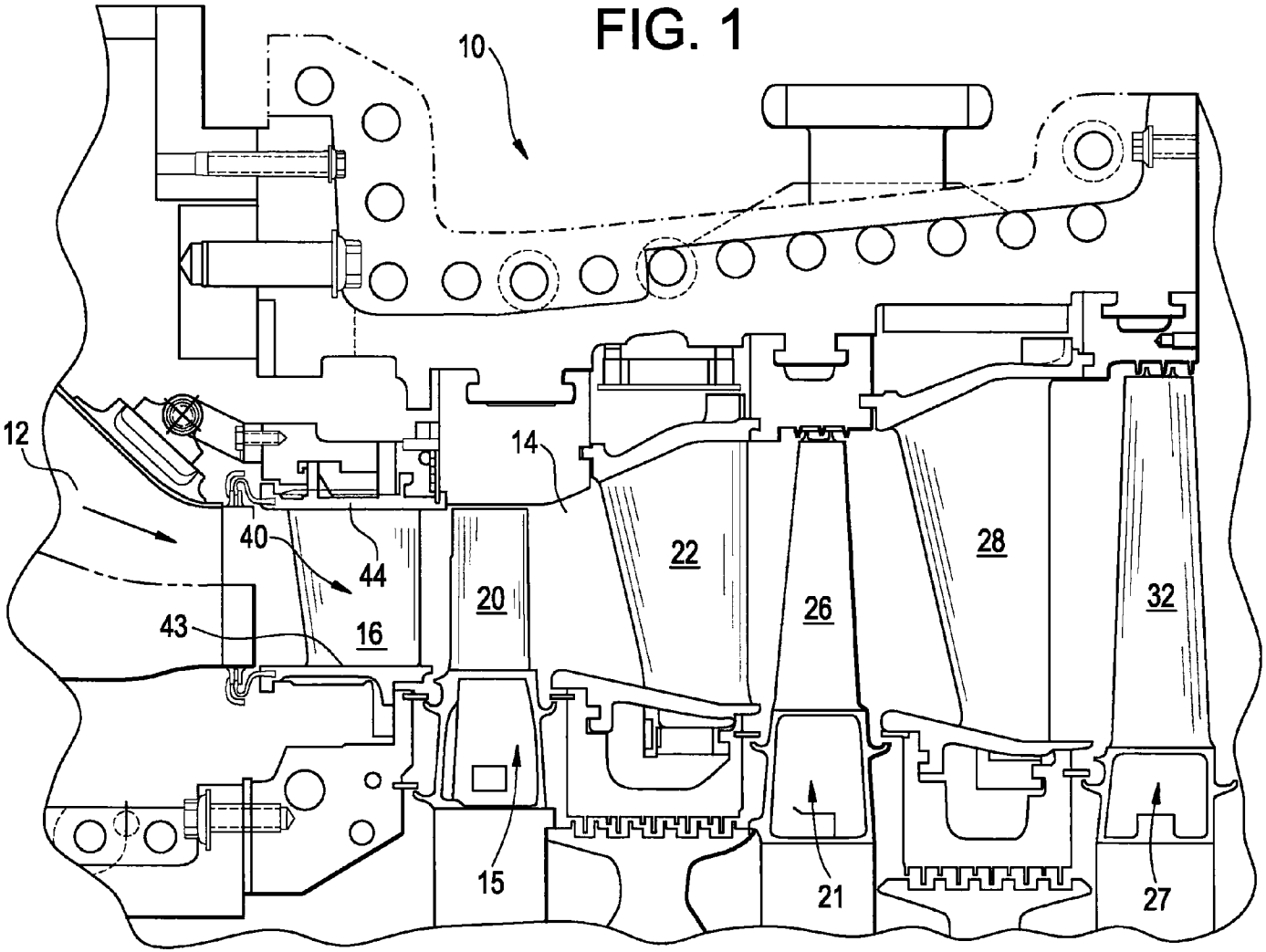
FIG. 1 schematically illustrates a turbine engine having at least a first stage employing turbine nozzles having airfoil cores constructed in accordance with an exemplary embodiment of the invention.

With initial reference to FIG. 1, a gas turbine engine constructed in accordance with an exemplary embodiment of the invention is indicated generally at 10. Turbine engine 10 includes an axial flow path 12 and a plurality of turbine stages employing buckets and nozzles. As shown, turbine engine 10 includes a first turbine stage 15 having a first stage nozzle 16 and a first stage bucket 20, a second turbine stage 21 having a second stage nozzle 22 and a second stage bucket 26, and a third turbine stage 27 including a third stage nozzle 28 and a third stage bucket 32. Each turbine bucket 20, 26, and 32 is connected to a turbine wheel (not shown). First stage nozzle 16 includes an airfoil core 40 having first and second end portions 43 and 44. Airfoil core 40 has a profile including a three dimensional (3-D) shape that defines a pressure side 50 and a suction side 54 as well as a leading edge 60 and a trailing edge 64. (See FIG. 4). At this point it should be appreciated that turbine 10 includes a plurality of first stage nozzles 16 spaced, circumferentially, about a first stage nozzle assembly (not separately labeled).

An important aspect of the nozzle is a cold airfoil core profile shape, which in accordance with an exemplary embodiment of the invention, was configured for enhanced turbine performance. A list of X, Y, and Z coordinates for airfoil core 40 is presented in TABLE I, and meets turbine requirements for cooling flow, nozzle casting producibility and impingement tube insertability. Moreover, by maximizing an impingement cooling area, the particular shape of airfoil core 40 substantially eliminates the need for airfoil film cooling introduced downstream of the nozzle throat to still further enhance performance. The points are arrived at by iteration between aerodynamic and mechanical design improvements and are the only loci of points that allow gas turbine 10 to operate in an efficient, smooth manner. As will become more fully evident below, airfoil core 40 is represented as a set of 1440 points listed in TABLE 1. The 1440 points represent 12 sections of airfoil core 40 each containing 120 points. The X, Y, and Z coordinates, which represent a profile of airfoil core 40, are created in a coordinate system which is defined relative to a cold engine centerline axis (not separately labeled) of turbine engine 10. The origin of the coordinate system on the cold centerline axis is X=0.0, Y=0.0 and Z=0.0. The Z coordinate axis is defined as a radial line from the Y coordinate axis; the X coordinate axis is defined as being normal to a plane defined by the Y-Z axis. Airfoil sections are cut normal to the Z coordinate axis. X and Y points, which make up the airfoil core profile shape at each section, are in inches. The radial Z values in inches for the section planes start at bottom section or a point $Z_0$, closest to the cold centerline axis, to $Z_1$, a top section or a point farthest from the cold centerline axis.

The radial distance between each section is 0.6 inches such that a total radial distance of air foil core 40 is 6.6 inches. The bottom and top sections $Z_0$ and $Z_1$, may be obscured by cast-in features that are not included in the X, Y, and Z points that define airfoil core 40. All of the 1440 points are taken from a nominal cold or room temperature for each cross section of airfoil core 40. Each section is joined smoothly with adjacent sections to form the airfoil core profile shape.

It should be appreciated that as each nozzle 16 heats up during operation of turbine engine 10, the airfoil core profile shape will change as a result of stress and temperature. Thus, the X, Y and Z points are provided at cold or room temperature for manufacturing purposes. Since the manufactured airfoil core profile shape may be different from a nominal airfoil core profile shape defined in Table 1, a tolerance of ±0.060 inches from the nominal profile is allowed and thus defines an overall design envelope for the airfoil core profile shape. The overall design is robust to this design envelope without impairment of mechanical or aerodynamic properties of nozzle 16.

It should also be appreciated that the airfoil core 40 can be scaled up or scaled down geometrically for introductions into similar turbine designs, with smaller or larger frame size.

Consequently, the X, Y, and Z coordinates in inches may be multiplied or divided by the same constant or number/factor to provide a scaled up or scaled down version of nozzle 16 while retaining the airfoil core profile shape and unique properties.

Figure 2:
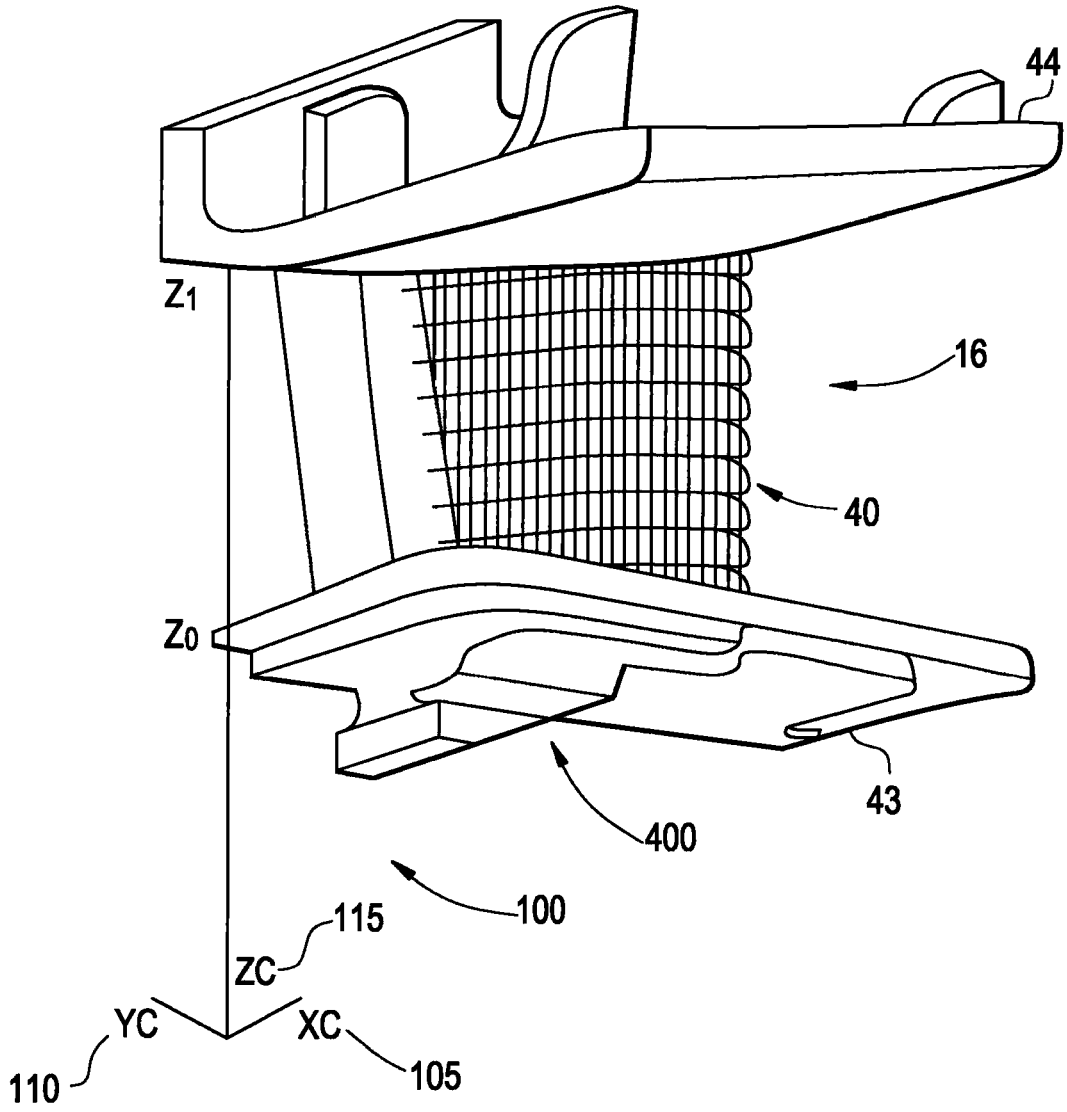
FIG. 2 illustrates a coordinate system for the airfoil cores in accordance with an exemplary embodiment of the invention.

As best shown in FIG. 2, a coordinate system for the airfoil core profile shape in accordance with exemplary embodiments of the invention is indicated generally at 100. As discussed above, coordinate system 100 is defined relative to a cold centerline axis (not separately labeled) of turbine engine 10. Coordinate system 100 includes an $X_C$-axis 105, a $Y_C$-axis 110, and a $Z_C$-axis 115. The origin of coordinate system 100 is centered on the cold engine centerline axis. $Z_C$-axis 115 is directed along a radial line normal to the cold engine centerline axis. The positive direction of $X_C$-axis 105, $Y_C$-axis 110, and $Z_C$-axis 115 is identified by label placement in FIG. 2.

Figure 3:
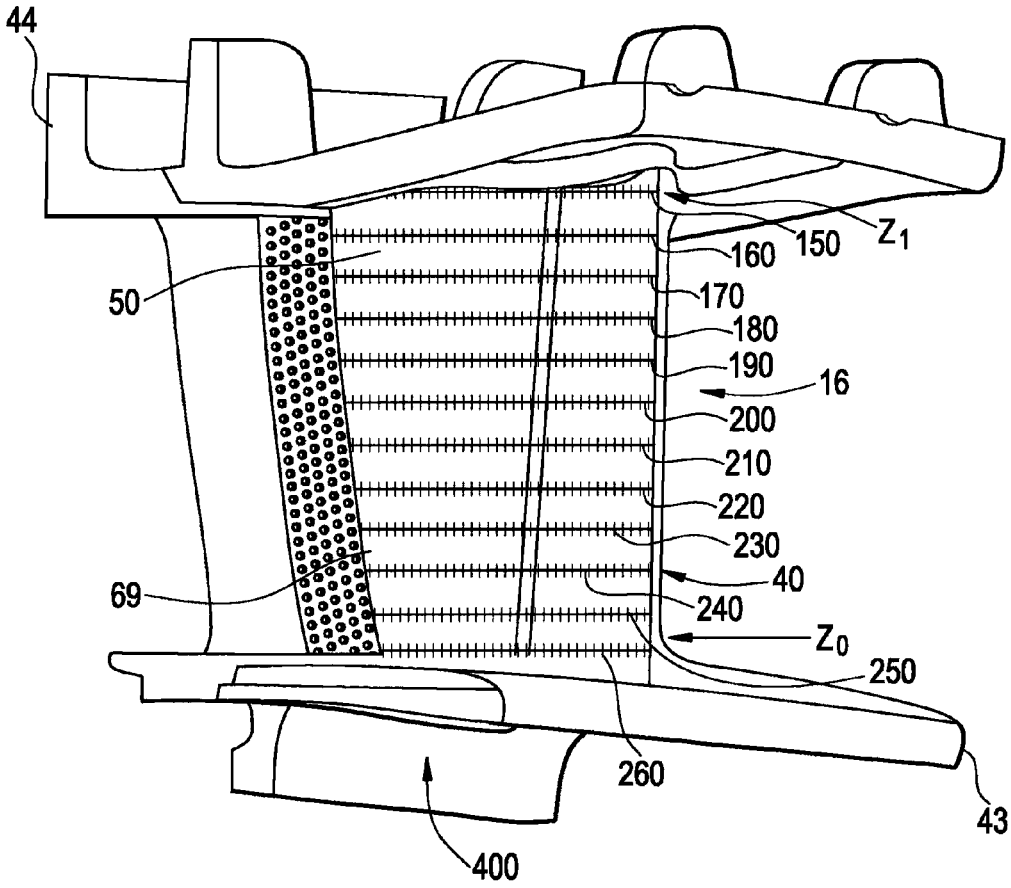
FIG. 3 is an left front perspective view of the airfoil core of FIG. 2.
Figure 4:
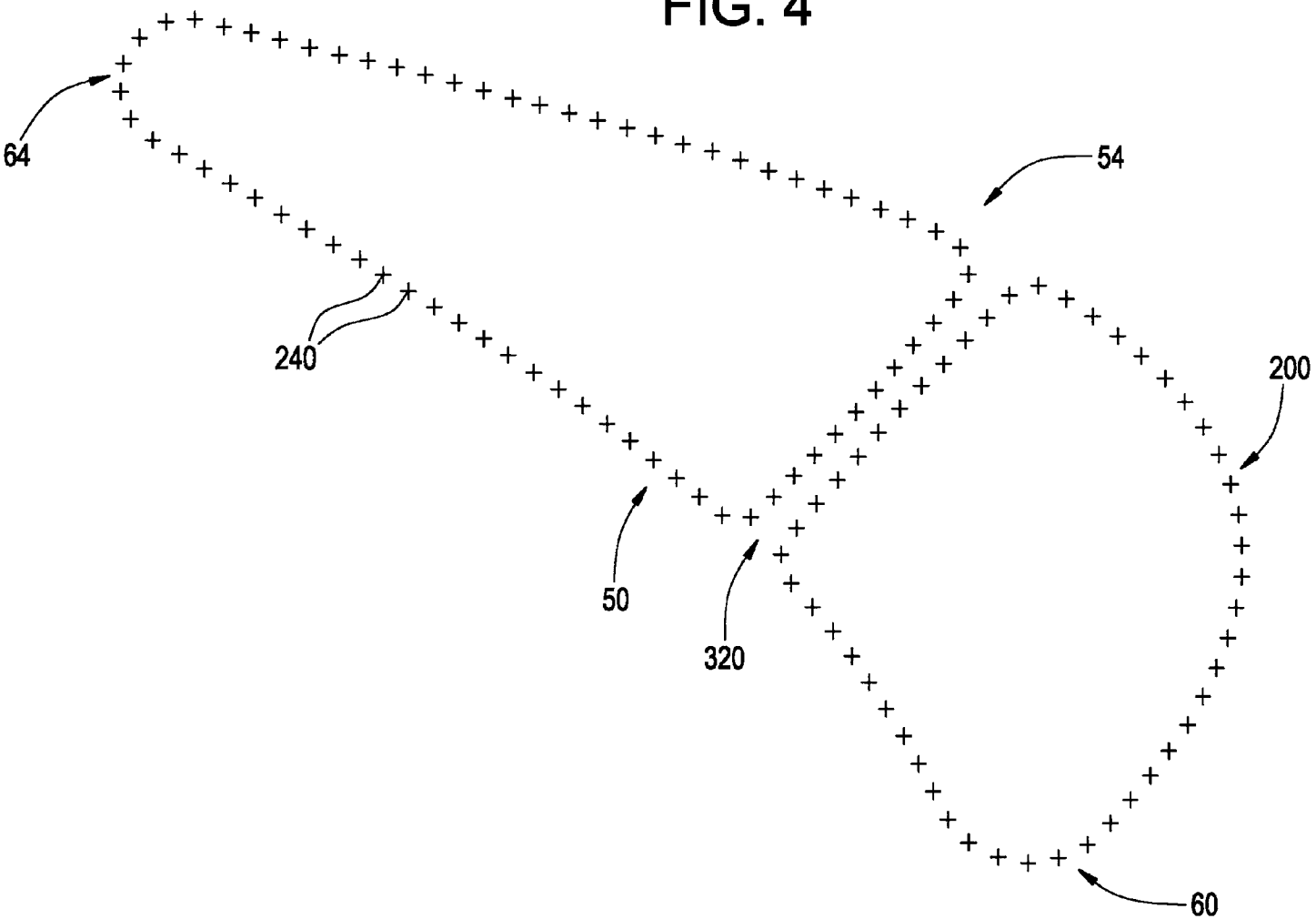
FIG. 4 illustrates a typical section taken through the airfoil core of FIG. 3.
Figure 5:
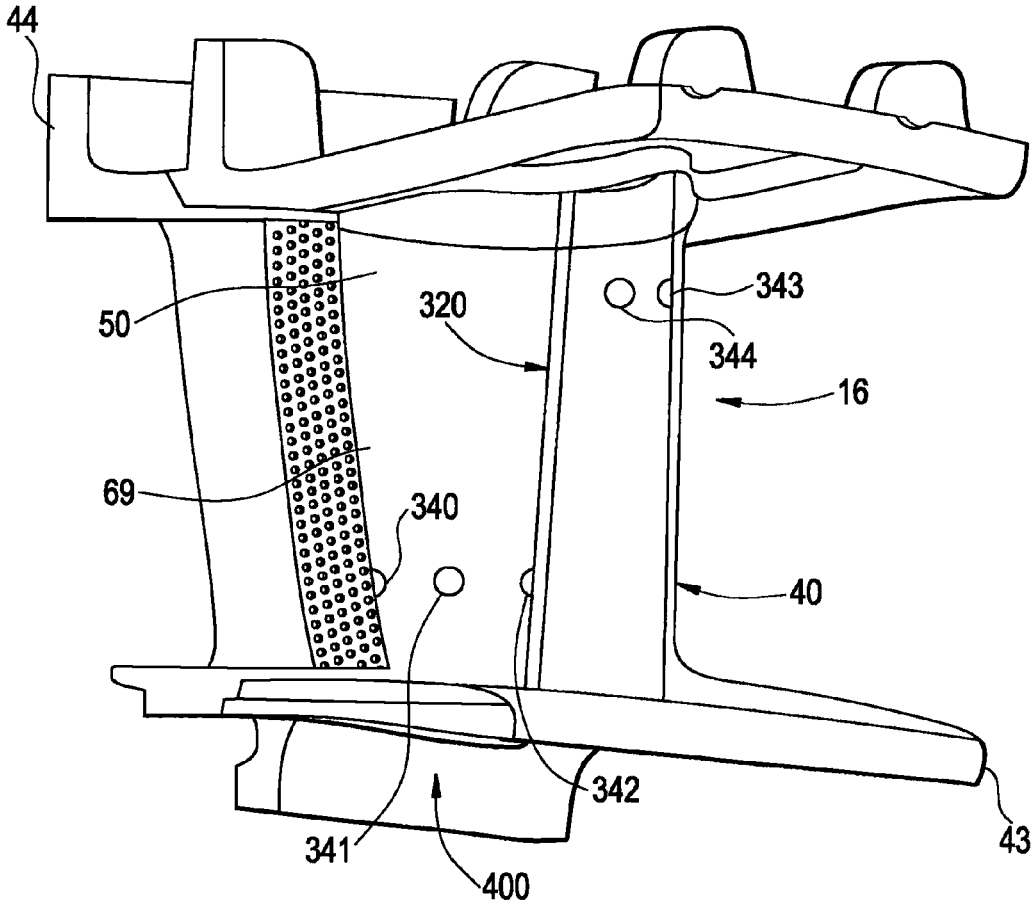
FIG. 5 is a left front perspective view of the airfoil core illustrating a longitudinal rib and core stand offs.

As best shown in FIG. 3, airfoil core 40 includes a plurality of sections 150-260. Section 150 is located at $Z_1$ and the air core profile shape extends through sections 150-250 before terminating at section 260 located at $Z_0$. As discussed above, sections 150-260 are cut normal to $Z_C$-axis 115. The X and Y coordinates which make up each section are presented in Table 1 are in inches. FIG. 4 illustrates points 240 which make up section 200. In addition to the airfoil core profile shape, the X, Y, and Z coordinates also define a rib profile 320. Rib profile 320 is particularly configured for impingement tube insertability as well as casting producibility. Core standoffs 340-344, which are not defined by the X, Y, Z coordinates listed in Table 1, are particularly located to position sheet metal impingement tubes.

Figure 6:
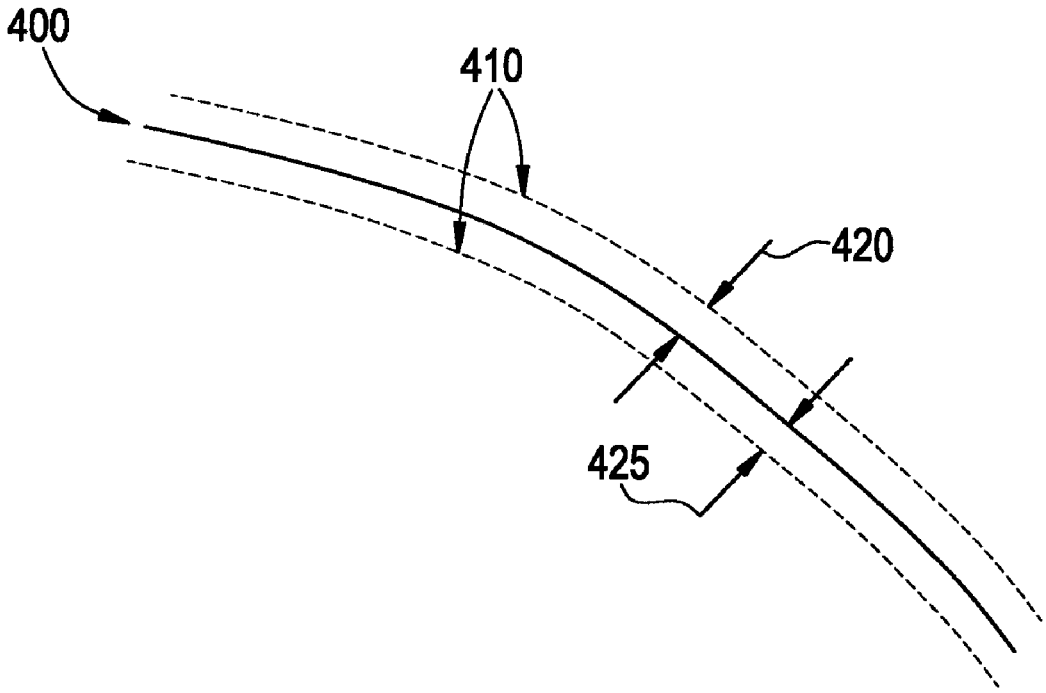
FIG. 6 illustrates an outer envelope of a nominal profile of the airfoil core.

FIG. 6 illustrates a design envelope for airfoil core 40. The X, Y, and Z values listed in TABLE 1 illustrate ideal point location for each point of each section of airfoil core 40. However, there exist variations from the ideal point location attributed to manufacturing tolerances and the like which must be taken into account. Thus, a design envelope is established which sets forth an acceptable outer boundary or distance from a nominal profile 400 for each section 150-260. Therefore it should be understood that each X, Y, and Z point includes a tolerance or ± value. In consideration of process capability, a tolerance 410 of 0.120 inches is allowed in the formation of airfoil core 40. Tolerance 410 includes an upper limit 420 defined as a 0.060-inch deviation from nominal profile 400 and a lower limit, defined as a −0.060-inch variation from nominal profile 400. The design envelope or tolerance 410 is robust such that this variation does not impair mechanical and aerodynamic performance of nozzle 16.

In no way limiting of the invention, airfoil core 40 provides an increased efficiency as much as 0.08% compared to previous individual airfoil cores. Moreover, and in no way limiting of the invention, in conjunction with other airfoil cores, which are conventional or enhanced (similar to the enhancements herein), airfoil core 40, as embodied by the invention, provides an increased efficiency as much as 0.08% compared to previous individual sets of airfoil cores. This increased efficiency provides, in addition to the above-noted advantages, a power output with a decrease the required fuel, therefore inherently decreasing emissions to produce energy. Of course, other such advantages are within the scope of the invention.

TABLE I

| Section 1 | | | Section 2 | | | Section 3 | | |
|---|---|---|---|---|---|---|---|---|
| X | Y | Z | X | Y | Z | X | Y | Z |
| 3.803 | −1.071 | 40.628 | 3.273 | −1.068 | 41.228 | 3.222 | −1.173 | 41.828 |
| 3.369 | −1.346 | 40.628 | 3.021 | −1.189 | 41.228 | 3.035 | −1.636 | 41.828 |
| 3.741 | −1.046 | 40.628 | 3.148 | −1.506 | 41.228 | 2.766 | −1.439 | 41.828 |
| 3.349 | −1.152 | 40.628 | 3.386 | −1.694 | 41.228 | 3.141 | −1.150 | 41.828 |
| 3.411 | −1.398 | 40.628 | 3.198 | −1.063 | 41.228 | 3.624 | −1.291 | 41.828 |
| 3.380 | −1.093 | 40.628 | 3.633 | −1.187 | 41.228 | 2.732 | −1.279 | 41.828 |
| 3.426 | −1.044 | 40.628 | 3.036 | −1.406 | 41.228 | 2.825 | −1.497 | 41.828 |
| 3.344 | −1.284 | 40.628 | 3.346 | −1.091 | 41.228 | 2.895 | −1.543 | 41.828 |
| 3.508 | −1.490 | 40.628 | 3.208 | −1.552 | 41.228 | 2.733 | −1.362 | 41.828 |
| 3.411 | −1.398 | 40.628 | 3.064 | −1.127 | 41.228 | 2.979 | −1.105 | 41.828 |
| 3.679 | −1.021 | 40.628 | 3.327 | −1.646 | 41.228 | 2.762 | −1.201 | 41.828 |
| 3.460 | −1.444 | 40.628 | 3.088 | −1.461 | 41.228 | 3.173 | −1.731 | 41.828 |
| 3.484 | −1.011 | 40.628 | 3.704 | −1.211 | 41.228 | 3.544 | −1.267 | 41.828 |
| 3.549 | −0.996 | 40.628 | 3.006 | −1.337 | 41.228 | 2.965 | −1.589 | 41.828 |
| 3.337 | −1.218 | 40.628 | 3.776 | −1.236 | 41.228 | 3.383 | −1.220 | 41.828 |
| 3.615 | −1.000 | 40.628 | 3.268 | −1.599 | 41.228 | 2.896 | −1.107 | 41.828 |
| 3.742 | −1.730 | 40.628 | 3.561 | −1.163 | 41.228 | 3.060 | −1.127 | 41.828 |
| 4.047 | −2.085 | 40.628 | 3.417 | −1.115 | 41.228 | 2.825 | −1.497 | 41.828 |
| 3.865 | −1.096 | 40.628 | 3.489 | −1.139 | 41.228 | 3.463 | −1.243 | 41.828 |
| 3.696 | −1.681 | 40.628 | 3.088 | −1.461 | 41.228 | 3.104 | −1.684 | 41.828 |
| 3.962 | −1.981 | 40.628 | 3.001 | −1.261 | 41.228 | 3.242 | −1.780 | 41.828 |
| 3.989 | −1.147 | 40.628 | 3.126 | −1.083 | 41.228 | 3.302 | −1.196 | 41.828 |
| 3.919 | −1.930 | 40.628 | 3.445 | −1.742 | 41.228 | 2.820 | −1.141 | 41.828 |
| 4.543 | −1.384 | 40.628 | 4.133 | −1.361 | 41.228 | 4.264 | −1.493 | 41.828 |
| 3.876 | −1.879 | 40.628 | 3.675 | −1.939 | 41.228 | 3.843 | −2.237 | 41.828 |
| 3.650 | −1.632 | 40.628 | 3.848 | −1.260 | 41.228 | 4.423 | −1.548 | 41.828 |
| 4.236 | −1.250 | 40.628 | 3.561 | −1.839 | 41.228 | 3.646 | −2.079 | 41.828 |
| 3.832 | −1.829 | 40.628 | 3.731 | −1.989 | 41.228 | 3.513 | −1.977 | 41.828 |
| 4.420 | −1.330 | 40.628 | 4.417 | −1.467 | 41.228 | 4.105 | −1.441 | 41.828 |
| 4.088 | −2.138 | 40.628 | 4.275 | −1.413 | 41.228 | 3.945 | −1.390 | 41.828 |
| 4.482 | −1.357 | 40.628 | 3.919 | −1.285 | 41.228 | 3.446 | −1.927 | 41.828 |
| 4.298 | −1.276 | 40.628 | 4.558 | −1.522 | 41.228 | 4.025 | −1.415 | 41.828 |
| 4.174 | −1.224 | 40.628 | 4.346 | −1.440 | 41.228 | 3.971 | −2.345 | 41.828 |
| 4.359 | −1.303 | 40.628 | 3.618 | −1.889 | 41.228 | 3.378 | −1.877 | 41.828 |
| 3.927 | −1.122 | 40.628 | 4.062 | −1.336 | 41.228 | 4.184 | −1.467 | 41.828 |
| 3.603 | −1.584 | 40.628 | 4.058 | −2.304 | 41.228 | 3.865 | −1.365 | 41.828 |
| 4.113 | −1.198 | 40.628 | 4.204 | −1.387 | 41.228 | 3.907 | −2.291 | 41.828 |

TABLE I-continued

| | | | | | | | | |
|---|---|---|---|---|---|---|---|---|
| 3.556 | −1.537 | 40.628 | 3.503 | −1.790 | 41.228 | 3.704 | −1.316 | 41.828 |
| 3.787 | −1.779 | 40.628 | 3.842 | −2.092 | 41.228 | 3.785 | −1.340 | 41.828 |
| 4.051 | −1.172 | 40.628 | 3.991 | −1.310 | 41.228 | 3.778 | −2.184 | 41.828 |
| 4.005 | −2.033 | 40.628 | 3.951 | −2.197 | 41.228 | 3.580 | −2.028 | 41.828 |
| 4.598 | −2.894 | 40.628 | 4.488 | −1.494 | 41.228 | 4.344 | −1.520 | 41.828 |
| 4.927 | −2.056 | 40.628 | 3.897 | −2.144 | 41.228 | 3.712 | −2.131 | 41.828 |
| 4.565 | −2.259 | 40.628 | 3.787 | −2.040 | 41.228 | 3.310 | −1.828 | 41.828 |
| 4.883 | −1.916 | 40.628 | 4.005 | −2.251 | 41.228 | 4.034 | −2.400 | 41.828 |
| 4.422 | −2.400 | 40.628 | 4.628 | −1.550 | 41.228 | 4.839 | −2.156 | 41.828 |
| 4.964 | −1.588 | 40.628 | 4.698 | −1.579 | 41.228 | 4.670 | −2.343 | 41.828 |
| 4.785 | −1.498 | 40.628 | 4.838 | −1.639 | 41.228 | 4.762 | −2.417 | 41.828 |
| 4.846 | −2.140 | 40.628 | 4.907 | −1.669 | 41.228 | 5.044 | −1.894 | 41.828 |
| 4.928 | −1.866 | 40.628 | 4.768 | −1.609 | 41.228 | 4.159 | −2.513 | 41.828 |
| 4.295 | −2.400 | 40.628 | 4.111 | −2.359 | 41.228 | 4.688 | −2.502 | 41.828 |
| 4.472 | −2.355 | 40.628 | 4.876 | −2.018 | 41.228 | 4.502 | −1.576 | 41.828 |
| 4.905 | −1.558 | 40.628 | 4.625 | −2.976 | 41.228 | 4.894 | −2.093 | 41.828 |
| 4.767 | −2.227 | 40.628 | 4.410 | −2.514 | 41.228 | 4.614 | −2.586 | 41.828 |
| 4.972 | −1.815 | 40.628 | 4.830 | −2.249 | 41.228 | 4.816 | −1.693 | 41.828 |
| 4.795 | −2.016 | 40.628 | 4.340 | −2.541 | 41.228 | 4.540 | −2.671 | 41.828 |
| 4.612 | −2.211 | 40.628 | 4.826 | −2.074 | 41.228 | 4.581 | −1.604 | 41.828 |
| 4.845 | −1.528 | 40.628 | 4.727 | −2.188 | 41.228 | 5.032 | −1.813 | 41.828 |
| 5.013 | −1.763 | 40.628 | 4.754 | −2.334 | 41.228 | 4.285 | −2.622 | 41.828 |
| 4.690 | −2.315 | 40.628 | 4.976 | −1.903 | 41.228 | 4.482 | −2.766 | 41.828 |
| 4.658 | −2.164 | 40.628 | 4.268 | −2.522 | 41.228 | 4.220 | −2.570 | 41.828 |
| 4.129 | −2.191 | 40.628 | 4.678 | −2.420 | 41.228 | 5.233 | −1.933 | 41.828 |
| 4.518 | −2.307 | 40.628 | 4.674 | −2.243 | 41.228 | 4.949 | −2.030 | 41.828 |
| 4.613 | −2.402 | 40.628 | 4.603 | −2.506 | 41.228 | 4.512 | −2.871 | 41.828 |
| 4.839 | −1.966 | 40.628 | 4.569 | −2.352 | 41.228 | 5.151 | −2.008 | 41.828 |
| 5.029 | −1.698 | 40.628 | 4.214 | −2.470 | 41.228 | 4.367 | −2.629 | 41.828 |
| 4.537 | −2.490 | 40.628 | 4.528 | −2.592 | 41.228 | 4.728 | −2.282 | 41.828 |
| 5.012 | −1.635 | 40.628 | 5.351 | −1.895 | 41.228 | 4.494 | −2.523 | 41.828 |
| 4.705 | −2.116 | 40.628 | 4.776 | −2.131 | 41.228 | 5.072 | −2.089 | 41.828 |
| 4.466 | −2.582 | 40.628 | 5.016 | −1.840 | 41.228 | 4.894 | −1.724 | 41.828 |
| 4.725 | −1.469 | 40.628 | 4.622 | −2.297 | 41.228 | 4.097 | −2.456 | 41.828 |
| 5.281 | −1.777 | 40.628 | 4.464 | −2.686 | 41.228 | 4.512 | −2.871 | 41.828 |
| 4.751 | −2.067 | 40.628 | 5.244 | −1.862 | 41.228 | 4.972 | −1.756 | 41.828 |
| 4.476 | −2.695 | 40.628 | 4.487 | −2.794 | 41.228 | 4.994 | −2.170 | 41.828 |
| 4.476 | −2.695 | 40.628 | 5.149 | −1.920 | 41.228 | 5.004 | −1.966 | 41.828 |
| 4.169 | −2.244 | 40.628 | 4.974 | −1.704 | 41.228 | 4.660 | −1.633 | 41.828 |
| 4.603 | −1.412 | 40.628 | 4.162 | −2.414 | 41.228 | 4.738 | −1.663 | 41.828 |
| 4.249 | −2.352 | 40.628 | 5.069 | −2.003 | 41.228 | 4.587 | −2.955 | 41.828 |
| 5.172 | −1.806 | 40.628 | 4.516 | −2.406 | 41.228 | 4.915 | −2.251 | 41.828 |
| 4.664 | −1.440 | 40.628 | 4.926 | −1.961 | 41.228 | 4.436 | −2.584 | 41.828 |
| 5.090 | −1.889 | 40.628 | 4.487 | −2.794 | 41.228 | 4.611 | −2.403 | 41.828 |
| 4.538 | −2.794 | 40.628 | 5.016 | −1.765 | 41.228 | 4.783 | −2.219 | 41.828 |
| 4.209 | −2.298 | 40.628 | 4.989 | −2.084 | 41.228 | 4.837 | −2.332 | 41.828 |
| 5.008 | −1.973 | 40.628 | 4.557 | −2.884 | 41.228 | 4.553 | −2.463 | 41.828 |
| 4.358 | −2.418 | 40.628 | 4.463 | −2.460 | 41.228 | 5.456 | −3.941 | 41.828 |
| 5.831 | −2.205 | 40.628 | 4.910 | −2.167 | 41.228 | 4.729 | −3.130 | 41.828 |
| 5.813 | −3.673 | 40.628 | 5.287 | −3.900 | 41.228 | 5.632 | −2.104 | 41.828 |
| 5.949 | −3.483 | 40.628 | 5.727 | −2.154 | 41.228 | 6.179 | −3.021 | 41.828 |
| 4.657 | −2.995 | 40.628 | 6.127 | −3.150 | 41.228 | 5.567 | −3.925 | 41.828 |
| 5.749 | −2.122 | 40.628 | 5.396 | −3.935 | 41.228 | 4.798 | −3.219 | 41.828 |
| 4.715 | −3.096 | 40.628 | 4.691 | −3.070 | 41.228 | 5.538 | −2.043 | 41.828 |
| 5.662 | −2.043 | 40.628 | 5.638 | −2.083 | 41.228 | 6.185 | −2.908 | 41.828 |
| 6.057 | −3.277 | 40.628 | 6.151 | −3.038 | 41.228 | 5.668 | −3.875 | 41.828 |
| 6.097 | −3.167 | 40.628 | 5.509 | −3.932 | 41.228 | 4.864 | −3.311 | 41.828 |
| 6.125 | −3.054 | 40.628 | 4.756 | −3.164 | 41.228 | 5.441 | −1.985 | 41.828 |
| 5.572 | −1.969 | 40.628 | 5.544 | −2.016 | 41.228 | 6.173 | −2.796 | 41.828 |
| 5.478 | −1.900 | 40.628 | 6.160 | −2.924 | 41.228 | 5.749 | −3.798 | 41.828 |
| 6.136 | −2.821 | 40.628 | 5.617 | −3.894 | 41.228 | 4.928 | −3.403 | 41.828 |
| 4.891 | −3.399 | 40.628 | 4.820 | −3.259 | 41.228 | 5.342 | −1.931 | 41.828 |
| 4.951 | −3.499 | 40.628 | 5.449 | −1.954 | 41.228 | 6.145 | −2.687 | 41.828 |
| 5.382 | −1.834 | 40.628 | 4.882 | −3.355 | 41.228 | 5.824 | −3.713 | 41.828 |
| 6.118 | −2.706 | 40.628 | 6.152 | −2.810 | 41.228 | 4.990 | −3.497 | 41.828 |
| 6.139 | −2.938 | 40.628 | 5.706 | −3.823 | 41.228 | 6.100 | −2.584 | 41.828 |
| 5.331 | −3.923 | 40.628 | 6.128 | −2.699 | 41.228 | 5.894 | −3.625 | 41.828 |
| 4.832 | −3.298 | 40.628 | 5.782 | −3.737 | 41.228 | 5.052 | −3.592 | 41.828 |
| 5.013 | −3.598 | 40.628 | 4.943 | −3.452 | 41.228 | 6.042 | −2.487 | 41.828 |
| 6.083 | −2.594 | 40.628 | 6.087 | −2.592 | 41.228 | 5.961 | −3.534 | 41.828 |
| 5.226 | −3.873 | 40.628 | 5.855 | −3.649 | 41.228 | 5.112 | −3.687 | 41.828 |
| 6.007 | −3.382 | 40.628 | 5.004 | −3.548 | 41.228 | 5.973 | −2.398 | 41.828 |
| 5.658 | −3.848 | 40.628 | 6.033 | −2.491 | 41.228 | 6.022 | −3.440 | 41.828 |
| 5.077 | −3.696 | 40.628 | 5.923 | −3.557 | 41.228 | 5.172 | −3.783 | 41.828 |
| 6.035 | −2.488 | 40.628 | 5.065 | −3.645 | 41.228 | 5.895 | −2.316 | 41.828 |
| 5.738 | −3.763 | 40.628 | 5.968 | −2.397 | 41.228 | 6.077 | −3.341 | 41.828 |
| 4.774 | −3.197 | 40.628 | 5.986 | −3.462 | 41.228 | 5.248 | −3.865 | 41.828 |
| 5.560 | −3.910 | 40.628 | 5.127 | −3.741 | 41.228 | 5.812 | −2.241 | 41.828 |
| 5.143 | −3.792 | 40.628 | 5.894 | −2.310 | 41.228 | 6.122 | −3.238 | 41.828 |
| 5.884 | −3.580 | 40.628 | 6.042 | −3.362 | 41.228 | 5.346 | −3.920 | 41.828 |

TABLE I-continued

| | | | | | | | | |
|---|---|---|---|---|---|---|---|---|
| 5.976 | −2.388 | 40.628 | 5.195 | −3.833 | 41.228 | 4.659 | −3.042 | 41.828 |
| 5.447 | −3.936 | 40.628 | 5.813 | −2.229 | 41.228 | 5.724 | −2.170 | 41.828 |
| 5.907 | −2.293 | 40.628 | 6.089 | −3.258 | 41.228 | 6.158 | −3.131 | 41.828 |

| Section 4 | | | Section 5 | | | Section 6 | | |
|---|---|---|---|---|---|---|---|---|
| X | Y | Z | X | Y | Z | X | Y | Z |
| 3.041 | −1.751 | 42.428 | 3.510 | −1.291 | 43.028 | 3.115 | −1.825 | 43.628 |
| 2.655 | −1.512 | 42.428 | 2.492 | −1.440 | 43.028 | 2.435 | −1.403 | 43.628 |
| 2.838 | −1.122 | 42.428 | 3.137 | −1.196 | 43.028 | 3.023 | −1.137 | 43.628 |
| 3.365 | −1.260 | 42.428 | 3.416 | −1.267 | 43.028 | 2.595 | −1.520 | 43.628 |
| 2.965 | −1.702 | 42.428 | 2.459 | −1.257 | 43.028 | 2.404 | −1.211 | 43.628 |
| 2.888 | −1.654 | 42.428 | 2.646 | −1.553 | 43.028 | 2.925 | −1.114 | 43.628 |
| 3.277 | −1.236 | 42.428 | 3.323 | −1.243 | 43.028 | 3.511 | −1.256 | 43.628 |
| 3.452 | −1.283 | 42.428 | 3.140 | −1.850 | 43.028 | 2.943 | −1.722 | 43.628 |
| 3.194 | −1.849 | 42.428 | 2.562 | −1.505 | 43.028 | 2.683 | −1.570 | 43.628 |
| 2.556 | −1.278 | 42.428 | 3.058 | −1.799 | 43.028 | 2.729 | −1.068 | 43.628 |
| 2.663 | −1.138 | 42.428 | 2.455 | −1.353 | 43.028 | 2.631 | −1.049 | 43.628 |
| 2.810 | −1.606 | 42.428 | 2.501 | −1.172 | 43.028 | 3.029 | −1.774 | 43.628 |
| 3.102 | −1.190 | 42.428 | 2.728 | −1.602 | 43.028 | 2.508 | −1.470 | 43.628 |
| 2.594 | −1.196 | 42.428 | 2.976 | −1.749 | 43.028 | 3.316 | −1.208 | 43.628 |
| 3.190 | −1.213 | 42.428 | 2.857 | −1.128 | 43.028 | 2.508 | −1.470 | 43.628 |
| 2.655 | −1.512 | 42.428 | 3.230 | −1.220 | 43.028 | 2.827 | −1.091 | 43.628 |
| 2.554 | −1.368 | 42.428 | 3.044 | −1.173 | 43.028 | 2.533 | −1.066 | 43.628 |
| 2.926 | −1.144 | 42.428 | 2.764 | −1.105 | 43.028 | 2.769 | −1.620 | 43.628 |
| 2.590 | −1.451 | 42.428 | 2.950 | −1.151 | 43.028 | 3.218 | −1.184 | 43.628 |
| 3.540 | −1.307 | 42.428 | 2.894 | −1.700 | 43.028 | 3.413 | −1.232 | 43.628 |
| 2.749 | −1.111 | 42.428 | 2.576 | −1.113 | 43.028 | 2.856 | −1.671 | 43.628 |
| 2.733 | −1.559 | 42.428 | 2.811 | −1.650 | 43.028 | 2.397 | −1.310 | 43.628 |
| 3.014 | −1.167 | 42.428 | 2.562 | −1.505 | 43.028 | 2.452 | −1.124 | 43.628 |
| 3.118 | −1.800 | 42.428 | 2.669 | −1.090 | 43.028 | 3.120 | −1.161 | 43.628 |
| 4.214 | −2.603 | 42.428 | 4.240 | −2.622 | 43.028 | 3.708 | −2.203 | 43.628 |
| 3.933 | −2.373 | 42.428 | 5.180 | −1.910 | 43.028 | 4.190 | −1.436 | 43.628 |
| 4.718 | −2.556 | 42.428 | 4.980 | −1.737 | 43.028 | 3.955 | −2.375 | 43.628 |
| 4.764 | −2.335 | 42.428 | 5.139 | −1.995 | 43.028 | 3.540 | −2.092 | 43.628 |
| 4.145 | −2.544 | 42.428 | 4.165 | −2.561 | 43.028 | 4.861 | −1.647 | 43.628 |
| 4.410 | −1.563 | 42.428 | 4.690 | −2.670 | 43.028 | 4.435 | −2.737 | 43.628 |
| 3.495 | −2.052 | 42.428 | 4.159 | −1.467 | 43.028 | 4.743 | −2.506 | 43.628 |
| 4.884 | −2.199 | 42.428 | 4.890 | −1.703 | 43.028 | 3.608 | −1.281 | 43.628 |
| 4.943 | −2.131 | 42.428 | 3.221 | −1.901 | 43.028 | 3.900 | −1.356 | 43.628 |
| 4.645 | −2.640 | 42.428 | 4.090 | −2.502 | 43.028 | 3.997 | −1.382 | 43.628 |
| 4.075 | −2.486 | 42.428 | 4.617 | −2.754 | 43.028 | 3.873 | −2.317 | 43.628 |
| 3.420 | −2.000 | 42.428 | 3.544 | −2.110 | 43.028 | 4.955 | −1.681 | 43.628 |
| 4.063 | −1.456 | 42.428 | 4.622 | −2.563 | 43.028 | 4.036 | −2.434 | 43.628 |
| 4.571 | −2.724 | 42.428 | 4.950 | −2.212 | 43.028 | 4.479 | −1.521 | 43.628 |
| 4.365 | −2.694 | 42.428 | 3.463 | −2.057 | 43.028 | 3.624 | −2.147 | 43.628 |
| 4.150 | −1.482 | 42.428 | 4.555 | −2.632 | 43.028 | 3.803 | −1.331 | 43.628 |
| 4.701 | −2.400 | 42.428 | 4.709 | −1.639 | 43.028 | 4.950 | −2.287 | 43.628 |
| 4.496 | −1.592 | 42.428 | 4.563 | −2.849 | 43.028 | 3.371 | −1.984 | 43.628 |
| 4.838 | −1.712 | 42.428 | 5.013 | −2.139 | 43.028 | 4.766 | −1.614 | 43.628 |
| 3.862 | −2.318 | 42.428 | 4.618 | −1.608 | 43.028 | 4.671 | −1.582 | 43.628 |
| 5.007 | −1.778 | 42.428 | 3.974 | −1.415 | 43.028 | 4.351 | −2.684 | 43.628 |
| 4.517 | −2.819 | 42.428 | 3.695 | −1.339 | 43.028 | 3.791 | −2.259 | 43.628 |
| 4.753 | −1.681 | 42.428 | 3.383 | −2.004 | 43.028 | 5.049 | −1.717 | 43.628 |
| 4.282 | −2.663 | 42.428 | 4.313 | −2.684 | 43.028 | 4.383 | −1.492 | 43.628 |
| 3.627 | −1.331 | 42.428 | 3.881 | −1.389 | 43.028 | 4.094 | −1.409 | 43.628 |
| 3.643 | −2.156 | 42.428 | 5.151 | −1.821 | 43.028 | 4.274 | −2.620 | 43.628 |
| 4.551 | −2.922 | 42.428 | 4.066 | −1.440 | 43.028 | 4.287 | −1.464 | 43.628 |
| 3.569 | −2.104 | 42.428 | 4.689 | −2.494 | 43.028 | 3.456 | −2.038 | 43.628 |
| 4.448 | −2.661 | 42.428 | 5.076 | −2.067 | 43.028 | 4.531 | −2.720 | 43.628 |
| 3.345 | −1.949 | 42.428 | 4.526 | −1.579 | 43.028 | 4.604 | −2.650 | 43.628 |
| 5.080 | −1.829 | 42.428 | 3.788 | −1.364 | 43.028 | 5.142 | −1.754 | 43.628 |
| 3.715 | −1.355 | 42.428 | 5.069 | −1.772 | 43.028 | 4.883 | −2.362 | 43.628 |
| 4.574 | −2.531 | 42.428 | 4.756 | −2.425 | 43.028 | 4.575 | −1.551 | 43.628 |
| 3.269 | −1.899 | 42.428 | 3.937 | −2.386 | 43.028 | 5.228 | −1.804 | 43.628 |
| 4.582 | −1.621 | 42.428 | 4.014 | −2.443 | 43.028 | 4.673 | −2.578 | 43.628 |
| 4.551 | −2.922 | 42.428 | 4.343 | −1.521 | 43.028 | 3.201 | −1.878 | 43.628 |
| 4.668 | −1.650 | 42.428 | 3.703 | −2.218 | 43.028 | 4.196 | −2.557 | 43.628 |
| 5.020 | −2.226 | 42.428 | 4.487 | −2.700 | 43.028 | 3.286 | −1.931 | 43.628 |
| 4.637 | −2.466 | 42.428 | 3.302 | −1.953 | 43.028 | 4.116 | −2.495 | 43.628 |
| 3.889 | −1.405 | 42.428 | 4.799 | −1.671 | 43.028 | 3.705 | −1.306 | 43.628 |
| 3.802 | −1.380 | 42.428 | 3.781 | −2.273 | 43.028 | 4.813 | −2.434 | 43.628 |
| 5.102 | −1.915 | 42.428 | 4.251 | −1.494 | 43.028 | 5.533 | −1.944 | 43.628 |
| 5.003 | −2.063 | 42.428 | 4.837 | −2.502 | 43.028 | 6.252 | −2.745 | 43.628 |
| 4.943 | −2.306 | 42.428 | 3.623 | −2.164 | 43.028 | 5.862 | −3.744 | 43.628 |
| 3.789 | −2.263 | 42.428 | 4.435 | −1.550 | 43.028 | 5.059 | −3.489 | 43.628 |
| 4.923 | −1.744 | 42.428 | 3.859 | −2.329 | 43.028 | 4.670 | −2.767 | 43.628 |
| 3.976 | −1.430 | 42.428 | 4.397 | −2.726 | 43.028 | 5.426 | −1.955 | 43.628 |
| 3.716 | −2.209 | 42.428 | 3.603 | −1.315 | 43.028 | 6.223 | −2.637 | 43.628 |

TABLE I-continued

| | | | | | | | | |
|---|---|---|---|---|---|---|---|---|
| 4.865 | −2.387 | 42.428 | 4.822 | −2.356 | 43.028 | 5.934 | −3.659 | 43.628 |
| 5.062 | −1.994 | 42.428 | 4.763 | −2.586 | 43.028 | 5.116 | −3.585 | 43.628 |
| 4.005 | −2.429 | 42.428 | 4.886 | −2.284 | 43.028 | 4.616 | −2.862 | 43.628 |
| 4.237 | −1.509 | 42.428 | 6.239 | −2.872 | 43.028 | 5.346 | −2.032 | 43.628 |
| 4.824 | −2.268 | 42.428 | 5.753 | −3.842 | 43.028 | 6.179 | −2.535 | 43.628 |
| 4.792 | −2.471 | 42.428 | 4.955 | −3.378 | 43.028 | 6.001 | −3.571 | 43.628 |
| 4.323 | −1.536 | 42.428 | 5.491 | −1.970 | 43.028 | 5.168 | −3.682 | 43.628 |
| 4.511 | −2.596 | 42.428 | 6.225 | −2.762 | 43.028 | 4.651 | −2.964 | 43.628 |
| 6.208 | −3.002 | 42.428 | 5.828 | −3.760 | 43.028 | 5.269 | −2.111 | 43.628 |
| 5.619 | −3.918 | 42.428 | 5.018 | −3.470 | 43.028 | 6.123 | −2.440 | 43.628 |
| 4.843 | −3.260 | 42.428 | 5.384 | −1.951 | 43.028 | 6.064 | −3.479 | 43.628 |
| 5.554 | −2.044 | 42.428 | 6.195 | −2.655 | 43.028 | 5.219 | −3.781 | 43.628 |
| 6.212 | −2.890 | 42.428 | 5.900 | −3.675 | 43.028 | 5.192 | −2.191 | 43.628 |
| 5.713 | −3.858 | 42.428 | 5.077 | −3.564 | 43.028 | 6.056 | −2.351 | 43.628 |
| 4.910 | −3.350 | 42.428 | 5.296 | −2.017 | 43.028 | 6.121 | −3.384 | 43.628 |
| 5.456 | −1.989 | 42.428 | 6.149 | −2.553 | 43.028 | 5.290 | −3.866 | 43.628 |
| 6.198 | −2.779 | 42.428 | 5.969 | −3.587 | 43.028 | 4.651 | −2.964 | 43.628 |
| 5.790 | −3.777 | 42.428 | 5.134 | −3.660 | 43.028 | 5.114 | −2.271 | 43.628 |
| 4.974 | −3.441 | 42.428 | 4.599 | −2.951 | 43.028 | 5.981 | −2.269 | 43.628 |
| 5.354 | −1.946 | 42.428 | 5.219 | −2.097 | 43.028 | 5.148 | −2.060 | 43.628 |
| 6.167 | −2.672 | 42.428 | 6.090 | −2.459 | 43.028 | 6.171 | −3.285 | 43.628 |
| 5.863 | −3.692 | 42.428 | 6.033 | −3.496 | 43.028 | 5.384 | −3.924 | 43.628 |
| 5.036 | −3.534 | 42.428 | 5.188 | −3.758 | 43.028 | 4.727 | −3.045 | 43.628 |
| 5.254 | −1.985 | 42.428 | 5.141 | −2.177 | 43.028 | 5.016 | −2.212 | 43.628 |
| 6.121 | −2.570 | 42.428 | 6.021 | −2.371 | 43.028 | 5.259 | −1.897 | 43.628 |
| 5.933 | −3.605 | 42.428 | 6.091 | −3.401 | 43.028 | 5.037 | −2.351 | 43.628 |
| 5.095 | −3.629 | 42.428 | 5.253 | −3.847 | 43.028 | 5.899 | −2.194 | 43.628 |
| 5.176 | −2.065 | 42.428 | 4.599 | −2.951 | 43.028 | 6.213 | −3.182 | 43.628 |
| 6.061 | −2.476 | 42.428 | 5.064 | −2.257 | 43.028 | 5.082 | −2.136 | 43.628 |
| 5.998 | −3.514 | 42.428 | 5.944 | −2.291 | 43.028 | 5.492 | −3.950 | 43.628 |
| 5.153 | −3.725 | 42.428 | 6.143 | −3.303 | 43.028 | 4.800 | −3.129 | 43.628 |
| 5.098 | −2.146 | 42.428 | 5.343 | −3.912 | 43.028 | 5.214 | −1.984 | 43.628 |
| 5.991 | −2.389 | 42.428 | 4.676 | −3.031 | 43.028 | 4.962 | −2.432 | 43.628 |
| 6.058 | −3.420 | 42.428 | 4.986 | −2.337 | 43.028 | 5.813 | −2.124 | 43.628 |
| 5.214 | −3.819 | 42.428 | 5.861 | −2.217 | 43.028 | 6.244 | −3.075 | 43.628 |
| 5.913 | −2.309 | 42.428 | 6.186 | −3.200 | 43.028 | 5.602 | −3.941 | 43.628 |
| 6.111 | −3.321 | 42.428 | 5.449 | −3.946 | 43.028 | 4.869 | −3.215 | 43.628 |
| 5.298 | −3.892 | 42.428 | 4.750 | −3.114 | 43.028 | 4.889 | −2.516 | 43.628 |
| 4.627 | −3.003 | 42.428 | 4.910 | −2.418 | 43.028 | 5.723 | −2.059 | 43.628 |
| 5.829 | −2.236 | 42.428 | 5.773 | −2.149 | 43.028 | 6.262 | −2.966 | 43.628 |
| 6.155 | −3.219 | 42.428 | 6.218 | −3.093 | 43.028 | 5.704 | −3.899 | 43.628 |
| 5.400 | −3.935 | 42.428 | 5.560 | −3.945 | 43.028 | 4.936 | −3.304 | 43.628 |
| 4.701 | −3.087 | 42.428 | 4.821 | −3.200 | 43.028 | 4.816 | −2.600 | 43.628 |
| 5.740 | −2.167 | 42.428 | 5.681 | −2.085 | 43.028 | 5.630 | −1.999 | 43.628 |
| 6.188 | −3.112 | 42.428 | 6.236 | −2.983 | 43.028 | 6.265 | −2.855 | 43.628 |
| 5.511 | −3.944 | 42.428 | 5.665 | −3.910 | 43.028 | 5.788 | −3.827 | 43.628 |
| 4.773 | −3.173 | 42.428 | 4.890 | −3.288 | 43.028 | 4.999 | −3.396 | 43.628 |
| 5.649 | −2.103 | 42.428 | 5.587 | −2.025 | 43.028 | 4.743 | −2.684 | 43.628 |

| Section 7 | | | Section 8 | | | Section 9 | | |
|---|---|---|---|---|---|---|---|---|
| X | Y | Z | X | Y | Z | X | Y | Z |
| 2.645 | −1.513 | 44.228 | 2.984 | −1.665 | 44.828 | 2.592 | −1.386 | 45.428 |
| 2.918 | −1.066 | 44.228 | 2.614 | −1.447 | 44.828 | 2.490 | −0.870 | 45.428 |
| 3.005 | −1.722 | 44.228 | 3.333 | −1.116 | 44.828 | 2.705 | −0.909 | 45.428 |
| 3.221 | −1.139 | 44.228 | 2.497 | −0.934 | 44.828 | 3.452 | −1.096 | 45.428 |
| 2.364 | −1.140 | 44.228 | 3.168 | −1.776 | 44.828 | 2.401 | −1.276 | 45.428 |
| 2.555 | −1.461 | 44.228 | 3.437 | −1.142 | 44.828 | 2.401 | −1.276 | 45.428 |
| 2.826 | −1.617 | 44.228 | 3.125 | −1.064 | 44.828 | 3.133 | −1.014 | 45.428 |
| 3.019 | −1.090 | 44.228 | 2.317 | −1.166 | 44.828 | 2.497 | −1.331 | 45.428 |
| 2.464 | −1.410 | 44.228 | 2.400 | −0.977 | 44.828 | 2.969 | −1.612 | 45.428 |
| 2.715 | −1.019 | 44.228 | 3.076 | −1.720 | 44.828 | 2.919 | −0.961 | 45.428 |
| 2.421 | −1.053 | 44.228 | 2.521 | −1.394 | 44.828 | 2.812 | −0.935 | 45.428 |
| 3.525 | −1.214 | 44.228 | 2.603 | −0.940 | 44.828 | 2.324 | −1.199 | 45.428 |
| 3.120 | −1.115 | 44.228 | 2.812 | −0.989 | 44.828 | 2.781 | −1.499 | 45.428 |
| 2.915 | −1.669 | 44.228 | 2.892 | −1.610 | 44.828 | 3.239 | −1.041 | 45.428 |
| 2.389 | −1.339 | 44.228 | 2.799 | −1.555 | 44.828 | 3.559 | −1.124 | 45.428 |
| 2.464 | −1.410 | 44.228 | 2.707 | −0.965 | 44.828 | 3.157 | −1.727 | 45.428 |
| 2.353 | −1.242 | 44.228 | 2.351 | −1.267 | 44.828 | 2.875 | −1.555 | 45.428 |
| 3.183 | −1.830 | 44.228 | 2.427 | −1.341 | 44.828 | 2.388 | −0.907 | 45.428 |
| 2.736 | −1.564 | 44.228 | 2.335 | −1.062 | 44.828 | 2.686 | −1.442 | 45.428 |
| 2.613 | −0.996 | 44.228 | 3.020 | −1.039 | 44.828 | 2.316 | −0.988 | 45.428 |
| 2.510 | −1.002 | 44.228 | 3.229 | −1.090 | 44.828 | 3.063 | −1.669 | 45.428 |
| 3.424 | −1.189 | 44.228 | 2.706 | −1.501 | 44.828 | 3.026 | −0.988 | 45.428 |
| 2.816 | −1.043 | 44.228 | 2.916 | −1.014 | 44.828 | 2.598 | −0.883 | 45.428 |
| 3.094 | −1.776 | 44.228 | 2.427 | −1.341 | 44.828 | 3.346 | −1.068 | 45.428 |
| 3.323 | −1.164 | 44.228 | 3.541 | −1.169 | 44.828 | 2.293 | −1.095 | 45.428 |
| 3.727 | −1.265 | 44.228 | 3.621 | −2.062 | 44.828 | 4.719 | −1.467 | 45.428 |
| 4.129 | −1.373 | 44.228 | 3.853 | −1.250 | 44.828 | 5.028 | −1.583 | 45.428 |

TABLE I-continued

| | | | | | | | | |
|---|---|---|---|---|---|---|---|---|
| 5.118 | −1.697 | 44.228 | 4.676 | −1.492 | 44.828 | 3.665 | −1.152 | 45.428 |
| 3.449 | −1.995 | 44.228 | 3.441 | −1.946 | 44.828 | 3.528 | −1.963 | 45.428 |
| 4.052 | −2.403 | 44.228 | 4.574 | −1.459 | 44.828 | 4.300 | −1.332 | 45.428 |
| 4.329 | −1.430 | 44.228 | 3.645 | −1.195 | 44.828 | 4.415 | −2.613 | 45.428 |
| 5.069 | −2.212 | 44.228 | 3.976 | −2.304 | 44.828 | 4.925 | −1.542 | 45.428 |
| 3.537 | −2.051 | 44.228 | 3.711 | −2.121 | 44.828 | 5.329 | −1.716 | 45.428 |
| 3.272 | −1.884 | 44.228 | 4.893 | −2.453 | 44.828 | 5.230 | −1.669 | 45.428 |
| 3.626 | −1.239 | 44.228 | 3.350 | −1.889 | 44.828 | 4.614 | −1.432 | 45.428 |
| 4.858 | −2.442 | 44.228 | 3.531 | −2.004 | 44.828 | 3.711 | −2.085 | 45.428 |
| 5.021 | −1.658 | 44.228 | 3.888 | −2.242 | 44.828 | 4.158 | −2.405 | 45.428 |
| 4.727 | −1.553 | 44.228 | 4.266 | −1.365 | 44.828 | 4.510 | −1.397 | 45.428 |
| 3.928 | −1.318 | 44.228 | 4.472 | −1.427 | 44.828 | 3.982 | −2.273 | 45.428 |
| 4.641 | −2.667 | 44.228 | 4.369 | −1.396 | 44.828 | 4.822 | −1.504 | 45.428 |
| 4.628 | −1.521 | 44.228 | 4.163 | −1.336 | 44.828 | 3.877 | −1.210 | 45.428 |
| 3.361 | −1.939 | 44.228 | 3.259 | −1.832 | 44.828 | 4.245 | −2.473 | 45.428 |
| 3.797 | −2.223 | 44.228 | 4.744 | −2.608 | 44.828 | 4.769 | −2.624 | 45.428 |
| 4.218 | −2.529 | 44.228 | 4.317 | −2.565 | 44.828 | 4.692 | −2.704 | 45.428 |
| 5.138 | −2.134 | 44.228 | 5.277 | −1.723 | 44.828 | 4.331 | −2.542 | 45.428 |
| 4.379 | −2.661 | 44.228 | 4.819 | −2.530 | 44.828 | 3.250 | −1.785 | 45.428 |
| 3.624 | −2.107 | 44.228 | 3.800 | −2.181 | 44.828 | 3.343 | −1.844 | 45.428 |
| 3.883 | −2.282 | 44.228 | 4.060 | −1.306 | 44.828 | 3.893 | −2.210 | 45.428 |
| 4.786 | −2.517 | 44.228 | 4.778 | −1.527 | 44.828 | 4.089 | −1.269 | 45.428 |
| 4.670 | −2.866 | 44.228 | 3.749 | −1.222 | 44.828 | 3.620 | −2.024 | 45.428 |
| 4.460 | −2.726 | 44.228 | 4.980 | −1.600 | 44.828 | 3.983 | −1.239 | 45.428 |
| 5.302 | −1.791 | 44.228 | 5.179 | −1.680 | 44.828 | 4.591 | −2.738 | 45.428 |
| 4.714 | −2.592 | 44.228 | 4.480 | −2.704 | 44.828 | 3.802 | −2.147 | 45.428 |
| 4.724 | −2.772 | 44.228 | 4.879 | −1.563 | 44.828 | 4.071 | −2.338 | 45.428 |
| 4.924 | −1.622 | 44.228 | 4.579 | −2.737 | 44.828 | 5.129 | −1.625 | 45.428 |
| 3.968 | −2.342 | 44.228 | 3.956 | −1.278 | 44.828 | 4.405 | −1.364 | 45.428 |
| 4.826 | −1.587 | 44.228 | 5.080 | −1.639 | 44.828 | 3.436 | −1.904 | 45.428 |
| 4.529 | −1.490 | 44.228 | 4.063 | −2.367 | 44.828 | 4.498 | −2.685 | 45.428 |
| 3.711 | −2.164 | 44.228 | 4.148 | −2.432 | 44.828 | 3.771 | −1.181 | 45.428 |
| 3.827 | −1.291 | 44.228 | 4.233 | −2.498 | 44.828 | 4.195 | −1.300 | 45.428 |
| 5.001 | −2.291 | 44.228 | 4.399 | −2.634 | 44.828 | 5.145 | −2.224 | 45.428 |
| 4.229 | −1.401 | 44.228 | 4.670 | −2.685 | 44.828 | 5.362 | −1.975 | 45.428 |
| 4.931 | −2.367 | 44.228 | 4.916 | −2.610 | 44.828 | 5.996 | −2.159 | 45.428 |
| 4.299 | −2.595 | 44.228 | 5.710 | −1.961 | 44.828 | 4.929 | −3.144 | 45.428 |
| 4.029 | −1.345 | 44.228 | 5.968 | −2.164 | 44.828 | 5.099 | −2.452 | 45.428 |
| 4.429 | −1.459 | 44.228 | 4.844 | −2.693 | 44.828 | 5.218 | −2.141 | 45.428 |
| 4.561 | −2.732 | 44.228 | 5.610 | −1.921 | 44.828 | 4.993 | −3.232 | 45.428 |
| 4.136 | −2.466 | 44.228 | 5.041 | −2.298 | 44.828 | 4.921 | −2.466 | 45.428 |
| 5.214 | −1.736 | 44.228 | 6.046 | −2.241 | 44.828 | 4.884 | −2.699 | 45.428 |
| 5.472 | −1.960 | 44.228 | 4.891 | −3.139 | 44.828 | 5.397 | −2.134 | 45.428 |
| 5.150 | −3.596 | 44.228 | 4.772 | −2.776 | 44.828 | 5.053 | −3.323 | 45.428 |
| 5.206 | −2.055 | 44.228 | 5.514 | −1.968 | 44.828 | 5.246 | −2.291 | 45.428 |
| 5.395 | −2.039 | 44.228 | 4.822 | −3.053 | 44.828 | 5.109 | −3.416 | 45.428 |
| 5.318 | −2.119 | 44.228 | 4.718 | −2.869 | 44.828 | 5.170 | −2.370 | 45.428 |
| 5.241 | −2.198 | 44.228 | 5.438 | −2.047 | 44.828 | 5.742 | −1.953 | 45.428 |
| 5.327 | −1.889 | 44.228 | 4.750 | −2.971 | 44.828 | 5.915 | −2.086 | 45.428 |
| 4.703 | −2.968 | 44.228 | 4.968 | −2.376 | 44.828 | 4.790 | −2.976 | 45.428 |
| 5.164 | −2.278 | 44.228 | 5.361 | −2.126 | 44.828 | 5.290 | −2.058 | 45.428 |
| 6.015 | −2.252 | 44.228 | 5.111 | −2.217 | 44.828 | 5.027 | −2.534 | 45.428 |
| 4.703 | −2.968 | 44.228 | 5.364 | −1.783 | 44.828 | 5.473 | −2.055 | 45.428 |
| 4.777 | −3.050 | 44.228 | 5.285 | −2.205 | 44.828 | 5.640 | −1.922 | 45.428 |
| 5.088 | −2.357 | 44.228 | 5.209 | −2.284 | 44.828 | 5.073 | −2.307 | 45.428 |
| 5.936 | −2.175 | 44.228 | 5.382 | −1.886 | 44.828 | 5.161 | −3.513 | 45.428 |
| 4.848 | −3.135 | 44.228 | 5.322 | −1.974 | 44.828 | 5.426 | −1.887 | 45.428 |
| 5.014 | −2.439 | 44.228 | 5.133 | −2.363 | 44.828 | 5.549 | −1.977 | 45.428 |
| 5.852 | −2.104 | 44.228 | 5.182 | −2.136 | 44.828 | 4.997 | −2.387 | 45.428 |
| 4.916 | −3.222 | 44.228 | 4.750 | −2.971 | 44.828 | 4.956 | −2.617 | 45.428 |
| 4.941 | −2.522 | 44.228 | 5.060 | −2.445 | 44.828 | 4.845 | −2.545 | 45.428 |
| 5.274 | −1.977 | 44.228 | 5.886 | −2.091 | 44.828 | 4.790 | −2.976 | 45.428 |
| 5.763 | −2.038 | 44.228 | 4.988 | −2.528 | 44.828 | 5.322 | −2.213 | 45.428 |
| 4.796 | −2.689 | 44.228 | 5.799 | −2.024 | 44.828 | 5.830 | −2.018 | 45.428 |
| 4.979 | −3.312 | 44.228 | 5.252 | −2.055 | 44.828 | 4.759 | −2.874 | 45.428 |
| 4.869 | −2.606 | 44.228 | 6.230 | −2.512 | 44.828 | 5.416 | −1.781 | 45.428 |
| 5.672 | −1.976 | 44.228 | 6.116 | −2.325 | 44.828 | 4.861 | −3.058 | 45.428 |
| 5.040 | −3.405 | 44.228 | 6.179 | −2.416 | 44.828 | 4.813 | −2.782 | 45.428 |
| 5.574 | −1.927 | 44.228 | 4.957 | −3.227 | 44.828 | 6.252 | −2.509 | 45.428 |
| 5.097 | −3.499 | 44.228 | 5.181 | −3.604 | 44.828 | 5.483 | −3.924 | 45.428 |
| 6.248 | −2.623 | 44.228 | 5.131 | −3.506 | 44.828 | 5.698 | −3.915 | 45.428 |
| 5.962 | −3.642 | 44.228 | 5.077 | −3.411 | 44.828 | 6.240 | −3.248 | 45.428 |
| 6.206 | −2.521 | 44.228 | 5.019 | −3.317 | 44.828 | 6.292 | −2.611 | 45.428 |
| 6.029 | −3.554 | 44.228 | 6.218 | −3.256 | 44.828 | 5.591 | −3.936 | 45.428 |
| 5.199 | −3.695 | 44.228 | 6.258 | −3.153 | 44.828 | 6.140 | −2.322 | 45.428 |
| 6.153 | −2.425 | 44.228 | 5.562 | −3.940 | 44.828 | 6.280 | −3.147 | 45.428 |
| 6.091 | −3.462 | 44.228 | 6.288 | −3.048 | 44.828 | 6.309 | −3.042 | 45.428 |
| 5.249 | −3.793 | 44.228 | 5.670 | −3.922 | 44.828 | 5.793 | −3.862 | 45.428 |
| 6.088 | −2.335 | 44.228 | 5.454 | −3.925 | 44.828 | 6.077 | −3.532 | 45.428 |
| 6.147 | −3.367 | 44.228 | 6.305 | −2.940 | 44.828 | 6.071 | −2.238 | 45.428 |

TABLE I-continued

| | | | | | | | | |
|---|---|---|---|---|---|---|---|---|
| 5.324 | −3.874 | 44.228 | 5.767 | −3.871 | 44.828 | 5.304 | −3.806 | 45.428 |
| 6.196 | −3.268 | 44.228 | 5.356 | −3.876 | 44.828 | 6.329 | −2.825 | 45.428 |
| 5.421 | −3.926 | 44.228 | 6.308 | −2.830 | 44.828 | 5.250 | −3.712 | 45.428 |
| 6.236 | −3.165 | 44.228 | 5.846 | −3.795 | 44.828 | 5.870 | −3.785 | 45.428 |
| 5.529 | −3.946 | 44.228 | 6.297 | −2.721 | 44.828 | 6.326 | −2.934 | 45.428 |
| 6.267 | −3.059 | 44.228 | 5.918 | −3.713 | 44.828 | 5.207 | −3.611 | 45.428 |
| 5.638 | −3.932 | 44.228 | 6.270 | −2.614 | 44.828 | 5.384 | −3.879 | 45.428 |
| 6.284 | −2.950 | 44.228 | 5.988 | −3.628 | 44.828 | 5.942 | −3.703 | 45.428 |
| 5.737 | −3.884 | 44.228 | 5.278 | −3.800 | 44.828 | 6.012 | −3.619 | 45.428 |
| 6.287 | −2.840 | 44.228 | 6.054 | −3.540 | 44.828 | 6.138 | −3.441 | 45.428 |
| 5.819 | −3.810 | 44.228 | 6.115 | −3.449 | 44.828 | 6.318 | −2.717 | 45.428 |
| 6.275 | −2.730 | 44.228 | 6.170 | −3.354 | 44.828 | 6.201 | −2.413 | 45.428 |
| 5.892 | −3.727 | 44.228 | 5.226 | −3.704 | 44.828 | 6.192 | −3.347 | 45.428 |

| Section 10 | | | Section 11 | | | Section 12 | | |
|---|---|---|---|---|---|---|---|---|
| X | Y | Z | X | Y | Z | X | Y | Z |
| 2.393 | −0.841 | 46.028 | 2.312 | −0.964 | 46.628 | 2.453 | −1.097 | 47.228 |
| 2.395 | −1.214 | 46.028 | 2.425 | −0.780 | 46.628 | 2.355 | −0.904 | 47.228 |
| 2.395 | −1.214 | 46.028 | 2.644 | −0.778 | 46.628 | 2.644 | −1.219 | 47.228 |
| 2.609 | −0.828 | 46.028 | 2.415 | −1.153 | 46.628 | 3.458 | −0.946 | 47.228 |
| 3.063 | −1.623 | 46.028 | 3.081 | −0.893 | 46.628 | 3.114 | −1.533 | 47.228 |
| 2.968 | −1.563 | 46.028 | 2.754 | −0.806 | 46.628 | 3.208 | −1.598 | 47.228 |
| 3.368 | −1.023 | 46.028 | 2.607 | −1.272 | 46.628 | 2.453 | −1.097 | 47.228 |
| 3.152 | −0.966 | 46.028 | 2.988 | −1.515 | 46.628 | 2.378 | −1.014 | 47.228 |
| 3.584 | −1.082 | 46.028 | 2.702 | −1.333 | 46.628 | 2.475 | −0.725 | 47.228 |
| 2.718 | −0.856 | 46.028 | 2.798 | −1.393 | 46.628 | 2.391 | −0.798 | 47.228 |
| 2.683 | −1.387 | 46.028 | 3.176 | −1.640 | 46.628 | 3.021 | −1.470 | 47.228 |
| 2.289 | −1.028 | 46.028 | 2.344 | −0.857 | 46.628 | 2.913 | −0.791 | 47.228 |
| 2.491 | −1.271 | 46.028 | 2.511 | −1.213 | 46.628 | 2.927 | −1.406 | 47.228 |
| 3.043 | −0.938 | 46.028 | 3.408 | −0.983 | 46.628 | 2.804 | −0.761 | 47.228 |
| 2.499 | −0.810 | 46.028 | 2.534 | −0.755 | 46.628 | 3.349 | −0.915 | 47.228 |
| 2.316 | −0.921 | 46.028 | 3.190 | −0.923 | 46.628 | 3.567 | −0.978 | 47.228 |
| 3.260 | −0.995 | 46.028 | 2.893 | −1.454 | 46.628 | 2.833 | −1.343 | 47.228 |
| 2.873 | −1.504 | 46.028 | 3.082 | −1.577 | 46.628 | 2.585 | −0.705 | 47.228 |
| 2.317 | −1.135 | 46.028 | 2.863 | −0.835 | 46.628 | 2.548 | −1.158 | 47.228 |
| 2.587 | −1.329 | 46.028 | 3.517 | −1.014 | 46.628 | 2.695 | −0.731 | 47.228 |
| 2.826 | −0.883 | 46.028 | 2.415 | −1.153 | 46.628 | 2.738 | −1.281 | 47.228 |
| 2.778 | −1.445 | 46.028 | 3.299 | −0.953 | 46.628 | 3.023 | −0.822 | 47.228 |
| 2.935 | −46.628 | 46.028 | 2.972 | −0.864 | 46.628 | 3.131 | −0.852 | 47.228 |
| 3.158 | −1.683 | 46.028 | 2.338 | −1.072 | 46.628 | 3.240 | −0.883 | 47.228 |
| 3.476 | −1.052 | 46.028 | 3.917 | −2.156 | 46.628 | 4.119 | −2.270 | 47.228 |
| 3.800 | −1.142 | 46.028 | 4.097 | −2.293 | 46.628 | 4.430 | −1.253 | 47.228 |
| 3.346 | −1.804 | 46.028 | 3.550 | −1.894 | 46.628 | 4.855 | −1.408 | 47.228 |
| 3.532 | −1.928 | 46.028 | 4.381 | −1.276 | 46.628 | 3.850 | −2.062 | 47.228 |
| 4.258 | −2.452 | 46.028 | 4.361 | −2.505 | 46.628 | 5.168 | −1.539 | 47.228 |
| 4.430 | −2.595 | 46.028 | 4.807 | −1.426 | 46.628 | 3.892 | −1.077 | 47.228 |
| 3.439 | −1.866 | 46.028 | 3.842 | −1.108 | 46.628 | 4.323 | −1.216 | 47.228 |
| 5.073 | −1.568 | 46.028 | 4.058 | −1.173 | 46.628 | 4.207 | −2.341 | 47.228 |
| 4.229 | −1.268 | 46.028 | 5.325 | −1.650 | 46.628 | 5.065 | −1.494 | 47.228 |
| 3.991 | −2.248 | 46.028 | 5.223 | −1.601 | 46.628 | 4.381 | −2.486 | 47.228 |
| 5.277 | −1.660 | 46.028 | 3.457 | −1.829 | 46.628 | 3.300 | −1.662 | 47.228 |
| 4.865 | −1.484 | 46.028 | 4.166 | −1.206 | 46.628 | 4.030 | −2.200 | 47.228 |
| 4.015 | −1.204 | 46.028 | 4.912 | −1.467 | 46.628 | 3.393 | −1.728 | 47.228 |
| 4.336 | −1.301 | 46.028 | 3.364 | −1.766 | 46.628 | 4.643 | −1.328 | 47.228 |
| 3.252 | −1.743 | 46.028 | 3.734 | −1.076 | 46.628 | 4.215 | −1.180 | 47.228 |
| 4.344 | −2.523 | 46.028 | 3.826 | −2.090 | 46.628 | 3.668 | −1.927 | 47.228 |
| 4.170 | −2.383 | 46.028 | 4.595 | −1.349 | 46.628 | 4.550 | −2.636 | 47.228 |
| 3.810 | −2.117 | 46.028 | 4.488 | −1.312 | 46.628 | 3.940 | −2.130 | 47.228 |
| 4.969 | −1.525 | 46.028 | 4.274 | −2.433 | 46.628 | 4.537 | −1.290 | 47.228 |
| 4.655 | −1.407 | 46.028 | 3.734 | −2.024 | 46.628 | 5.271 | −1.587 | 47.228 |
| 4.443 | −1.336 | 46.028 | 4.447 | −2.579 | 46.628 | 4.466 | −2.560 | 47.228 |
| 3.625 | −1.990 | 46.028 | 5.120 | −1.555 | 46.628 | 4.960 | −1.450 | 47.228 |
| 4.604 | −2.734 | 46.028 | 5.017 | −1.510 | 46.628 | 3.577 | −1.860 | 47.228 |
| 5.175 | −1.613 | 46.028 | 3.625 | −1.044 | 46.628 | 4.636 | −2.709 | 47.228 |
| 4.081 | −2.315 | 46.028 | 4.008 | −2.224 | 46.628 | 4.294 | −2.413 | 47.228 |
| 3.908 | −1.172 | 46.028 | 3.270 | −1.702 | 46.628 | 3.675 | −1.011 | 47.228 |
| 4.760 | −1.445 | 46.028 | 4.701 | −1.387 | 46.628 | 3.759 | −1.994 | 47.228 |
| 3.718 | −2.053 | 46.028 | 3.950 | −1.140 | 46.628 | 4.749 | −1.368 | 47.228 |
| 4.514 | −2.669 | 46.028 | 4.274 | −1.241 | 46.628 | 4.107 | −1.145 | 47.228 |
| 4.122 | −1.235 | 46.028 | 4.186 | −2.362 | 46.628 | 3.485 | −1.794 | 47.228 |
| 4.549 | −1.371 | 46.028 | 3.642 | −1.958 | 46.628 | 3.783 | −1.044 | 47.228 |
| 3.692 | −1.112 | 46.028 | 4.619 | −2.724 | 46.628 | 4.000 | −1.111 | 47.228 |
| 3.901 | −2.182 | 46.028 | 4.531 | −2.654 | 46.628 | 5.514 | −1.882 | 47.228 |
| 5.134 | −2.454 | 46.028 | 5.095 | −2.530 | 46.628 | 5.562 | −2.046 | 47.228 |
| 5.431 | −2.137 | 46.028 | 5.313 | −2.287 | 46.628 | 4.848 | −2.867 | 47.228 |
| 4.945 | −2.476 | 46.028 | 4.728 | −2.719 | 46.628 | 5.637 | −1.967 | 47.228 |
| 5.773 | −1.949 | 46.028 | 5.122 | −2.316 | 46.628 | 4.903 | −2.775 | 47.228 |
| 5.377 | −1.710 | 46.028 | 5.024 | −2.612 | 46.628 | 4.829 | −2.636 | 47.228 |

TABLE I-continued

| | | | | | | | | |
|---|---|---|---|---|---|---|---|---|
| 5.205 | −2.372 | 46.028 | 5.388 | −2.208 | 46.628 | 5.218 | −2.225 | 47.228 |
| 5.082 | −3.323 | 46.028 | 5.538 | −2.052 | 46.628 | 5.441 | −1.968 | 47.228 |
| 5.394 | −1.977 | 46.028 | 4.953 | −2.694 | 46.628 | 5.723 | −1.902 | 47.228 |
| 5.461 | −1.780 | 46.028 | 5.614 | −1.973 | 46.628 | 4.974 | −2.692 | 47.228 |
| 5.671 | −1.922 | 46.028 | 5.271 | −2.146 | 46.628 | 5.189 | −3.415 | 47.228 |
| 4.891 | −3.059 | 46.028 | 5.805 | −1.941 | 46.628 | 5.292 | −2.139 | 47.228 |
| 4.867 | −2.556 | 46.028 | 4.882 | −2.777 | 46.628 | 5.827 | −1.919 | 47.228 |
| 5.582 | −1.980 | 46.028 | 5.890 | −2.009 | 46.628 | 5.046 | −2.609 | 47.228 |
| 4.849 | −2.783 | 46.028 | 4.823 | −2.867 | 46.628 | 5.136 | −3.319 | 47.228 |
| 5.506 | −2.058 | 46.028 | 5.491 | −1.888 | 46.628 | 5.064 | −2.391 | 47.228 |
| 5.321 | −2.061 | 46.028 | 5.237 | −2.365 | 46.628 | 5.913 | −1.987 | 47.228 |
| 5.063 | −2.536 | 46.028 | 5.425 | −1.702 | 46.628 | 5.117 | −2.527 | 47.228 |
| 4.790 | −2.637 | 46.028 | 4.888 | −2.560 | 46.628 | 5.077 | −3.227 | 47.228 |
| 5.247 | −2.146 | 46.028 | 4.846 | −2.970 | 46.628 | 5.994 | −2.059 | 47.228 |
| 5.463 | −1.889 | 46.028 | 5.197 | −2.231 | 46.628 | 5.188 | −2.444 | 47.228 |
| 5.356 | −2.215 | 46.028 | 5.463 | −2.130 | 46.628 | 5.014 | −3.138 | 47.228 |
| 5.174 | −2.230 | 46.028 | 4.916 | −3.053 | 46.628 | 5.473 | −1.690 | 47.228 |
| 5.205 | −2.372 | 46.028 | 5.419 | −1.975 | 46.628 | 6.071 | −2.137 | 47.228 |
| 5.186 | −3.514 | 46.028 | 5.703 | −1.915 | 46.628 | 5.143 | −2.309 | 47.228 |
| 5.137 | −3.417 | 46.028 | 5.345 | −2.061 | 46.628 | 5.260 | −2.361 | 47.228 |
| 4.711 | −2.716 | 46.028 | 5.044 | −2.397 | 46.628 | 4.947 | −3.052 | 47.228 |
| 5.022 | −3.232 | 46.028 | 5.972 | −2.080 | 46.628 | 4.908 | −2.555 | 47.228 |
| 6.022 | −2.159 | 46.028 | 4.810 | −2.642 | 46.628 | 5.367 | −2.054 | 47.228 |
| 4.959 | −3.144 | 46.028 | 5.237 | −2.365 | 46.628 | 5.335 | −2.282 | 47.228 |
| 5.100 | −2.314 | 46.028 | 6.050 | −2.156 | 46.628 | 5.373 | −1.637 | 47.228 |
| 4.821 | −2.976 | 46.028 | 5.503 | −1.780 | 46.628 | 4.877 | −2.968 | 47.228 |
| 5.280 | −2.293 | 46.028 | 4.966 | −2.479 | 46.628 | 5.410 | −2.204 | 47.228 |
| 4.793 | −2.874 | 46.028 | 5.166 | −2.448 | 46.628 | 5.540 | −1.776 | 47.228 |
| 4.920 | −2.701 | 46.028 | 6.246 | −2.416 | 46.628 | 4.986 | −2.473 | 47.228 |
| 5.860 | −2.015 | 46.028 | 6.295 | −2.513 | 46.628 | 5.486 | −2.125 | 47.228 |
| 5.943 | −2.085 | 46.028 | 6.122 | −2.237 | 46.628 | 4.877 | −2.968 | 47.228 |
| 5.022 | −2.395 | 46.028 | 6.188 | −2.324 | 46.628 | 4.745 | −2.711 | 47.228 |
| 4.991 | −2.618 | 46.028 | 5.209 | −3.509 | 46.628 | 6.313 | −2.498 | 47.228 |
| 6.157 | −3.440 | 46.028 | 4.983 | −3.138 | 46.628 | 5.274 | −3.616 | 47.228 |
| 5.231 | −3.613 | 46.028 | 5.160 | −3.412 | 46.628 | 6.074 | −3.609 | 47.228 |
| 6.349 | −2.826 | 46.028 | 5.047 | −3.226 | 46.628 | 6.351 | −2.600 | 47.228 |
| 6.329 | −3.042 | 46.028 | 5.106 | −3.317 | 46.628 | 5.235 | −3.514 | 47.228 |
| 5.962 | −3.700 | 46.028 | 5.906 | −3.783 | 46.628 | 6.004 | −3.693 | 47.228 |
| 6.312 | −2.612 | 46.028 | 6.367 | −2.829 | 46.628 | 6.376 | −2.706 | 47.228 |
| 6.274 | −2.511 | 46.028 | 5.734 | −3.912 | 46.628 | 5.931 | −3.775 | 47.228 |
| 5.406 | −3.880 | 46.028 | 6.364 | −2.937 | 46.628 | 6.388 | −2.815 | 47.228 |
| 6.224 | −2.414 | 46.028 | 5.628 | −3.934 | 46.628 | 5.854 | −3.852 | 47.228 |
| 5.613 | −3.934 | 46.028 | 5.422 | −3.878 | 46.628 | 6.386 | −2.924 | 47.228 |
| 6.338 | −2.718 | 46.028 | 6.347 | −3.045 | 46.628 | 5.761 | −3.908 | 47.228 |
| 5.890 | −3.782 | 46.028 | 5.341 | −3.805 | 46.628 | 6.370 | −3.032 | 47.228 |
| 6.299 | −3.147 | 46.028 | 6.317 | −3.149 | 46.628 | 5.655 | −3.933 | 47.228 |
| 6.097 | −2.238 | 46.028 | 6.278 | −3.250 | 46.628 | 6.342 | −3.137 | 47.228 |
| 5.325 | −3.808 | 46.028 | 6.230 | −3.348 | 46.628 | 5.547 | −3.924 | 47.228 |
| 6.164 | −2.324 | 46.028 | 5.828 | −3.859 | 46.628 | 6.303 | −3.239 | 47.228 |
| 6.212 | −3.346 | 46.028 | 6.175 | −3.442 | 46.628 | 6.143 | −2.219 | 47.228 |
| 5.813 | −3.858 | 46.028 | 5.520 | −3.922 | 46.628 | 5.446 | −3.883 | 47.228 |
| 5.270 | −3.714 | 46.028 | 6.114 | −3.532 | 46.628 | 6.255 | −3.337 | 47.228 |
| 6.097 | −3.530 | 46.028 | 6.332 | −2.615 | 46.628 | 6.208 | −2.307 | 47.228 |
| 6.260 | −3.248 | 46.028 | 5.286 | −3.712 | 46.628 | 5.363 | −3.812 | 47.228 |
| 6.031 | −3.617 | 46.028 | 6.048 | −3.618 | 46.628 | 6.200 | −3.432 | 47.228 |
| 6.346 | −2.935 | 46.028 | 5.251 | −3.609 | 46.628 | 6.265 | −2.400 | 47.228 |
| 5.505 | −3.923 | 46.028 | 5.978 | −3.702 | 46.628 | 5.306 | −3.720 | 47.228 |
| 5.719 | −3.912 | 46.028 | 6.357 | −2.721 | 46.628 | 6.139 | −3.522 | 47.228 |

At this point it should be understood that the points disclosed in Table 1 are exemplary, variations/deviations from the points in Table 1 at one or more sections that do not substantially affect the desired properties obtained by the airfoil core shape of the invention exemplary embodiments fall within the scope of the exemplary embodiments of the invention.

In general, this written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of exemplary embodiments of the present invention if they have structural elements that do not differ from the literal language of the claims, or if they include equivalent structural elements with insubstantial differences from the literal language of the claims.

The invention claimed is:

1. An article of manufacture comprising: an object having an airfoil core shape, the airfoil core shape having a nominal profile substantially in accordance with Cartesian coordinate values of X, Y, and Z set forth in TABLE 1, and wherein X and Y are distances in inches which, when connected by smooth continuing arcs, define airfoil profile sections at each distance Z in inches, the profile sections at the Z distances being joined smoothly with one another to form a complete airfoil core shape.

2. The article of manufacture according to claim 1, wherein the object comprises a core shape for a first stage turbine nozzle.

3. The article of manufacture according to claim 1, wherein the nominal profile lies within an envelope within 0.060 inches and −0.060 inches in a direction normal to any of the airfoil profile sections.

4. The article of manufacture according to claim 1, wherein the object comprises an airfoil.

5. A turbine comprising:

at least one turbine stage including a plurality of articles of manufacture, each of the plurality of articles of manufacture including an airfoil core shape, the airfoil core shape having a nominal profile substantially in accordance with Cartesian coordinate values of X, Y, and Z set forth in TABLE 1, and wherein X and Y are distances in inches which, when connected by smooth continuing arcs, define airfoil profile sections at each distance Z in inches, the profile sections at the Z distances being joined smoothly with one another to form a complete airfoil core shape.

6. The turbine according to claim 5, wherein each of the articles of manufacture comprises a core shape for a first stage turbine nozzle.

7. The turbine according to claim 5, wherein the nominal profile lies within an envelope within 0.060 inches and −0.060 inches in a direction normal to any of the airfoil profile sections.

* * * * *